United States Patent [19]

Etoh

[11] 4,129,620

[45] Dec. 12, 1978

[54] FUEL CHANGEOVER SYSTEM FOR MULTI-FUEL ENGINES

[75] Inventor: Motoaki Etoh, Ageo, Japan

[73] Assignee: Fuji Jukogyo Kabushiki Kaisha, Tokyo, Japan

[21] Appl. No.: 828,548

[22] Filed: Aug. 29, 1977

[30] Foreign Application Priority Data

Sep. 10, 1976 [JP] Japan ..... 51-109185

[51] Int. Cl.[2] ..... F02M 13/06

[52] U.S. Cl. ..... 261/18 R; 123/127; 261/69 A

[58] Field of Search ..... 261/18 R; 123/127; 261/69 A

[56] References Cited

U.S. PATENT DOCUMENTS

| | | | |
|---|---|---|---|
| 1,237,490 | 8/1917 | Edens | 261/18 R |
| 1,240,080 | 9/1917 | Morse et al. | 261/18 R |
| 1,258,938 | 3/1918 | Pape | 261/18 R |
| 1,299,904 | 4/1919 | Bowman | 261/18 R |
| 1,304,418 | 5/1919 | Van Briggle | 261/18 R |
| 1,426,685 | 8/1922 | Stratton | 261/18 R |
| 1,515,384 | 11/1924 | Frame | 261/18 R |
| 2,155,560 | 4/1939 | Malouf | 261/18 R |
| 3,805,756 | 4/1974 | Madariaga | 261/18R |

*Primary Examiner*—Tim R. Miles

*Attorney, Agent, or Firm*—Martin A. Farber

[57] ABSTRACT

Fuel changeover system for a multi-fuel engine of the type which may be driven by various fuels such as gasoline and kerosene, which enables the engine to continue the operation by another fuel when one of the fuels has run out. The system comprises two float chambers for two kinds of fuel and a cock with passages adapted to communicate both float chambers with each other for introducing the remaining fuel into the empty float chamber. The system, further, comprises a gasoline reservoir and valve means for supplying the gasoline in the reservoir to the carburetor in order to start the engine, when the gasoline in the float chamber runs out.

3 Claims, 7 Drawing Figures

FUEL CHANGEOVER SYSTEM FOR MULTI-FUEL ENGINES

This invention relates to a fuel changeover system for multifuel internal combustion engines such as gasoline-kerosene engines driven by gasoline and/or kerosene.

In the gasoline-kerosene engine, the carburetor is provided with a gasoline float chamber and a kerosene float chamber and means for supplying either of the fuels according to change of load. At the start of the engine gasoline is supplied from the gasoline float chamber to the carburetor in order to ensure the starting of the engine and kerosene is supplied at light and middle load for economical operation.

Therefore, when either of the fuels runs out, the engine cannot be smoothly driven by the remaining fuel. More particularly, if gasoline runs out, it is difficult to re-start the engine, and if kerosene runs out, the engine stops at a light or middle load.

Accordingly, a principal object of the present invention is to provide a system in which the both float chambers may be communicated with each other so that upon running out of one of fuels, the remaining fuel flows into the empty float chamber to allow the operation of the engine.

The engine, which satisfies the above object, has no problem when kerosene is used up, because gasoline is supplied to the carburetor. However, if gasoline is used up, there may be difficulties upon re-starting when enging is cold.

Accordingly, the other object of the present invention is to provide a system in which a small amount of gasoline is preserved and the gasoline can be supplied to a nozzle of the carburetor so as to ensure the start of the engine at any time.

Figure 1:
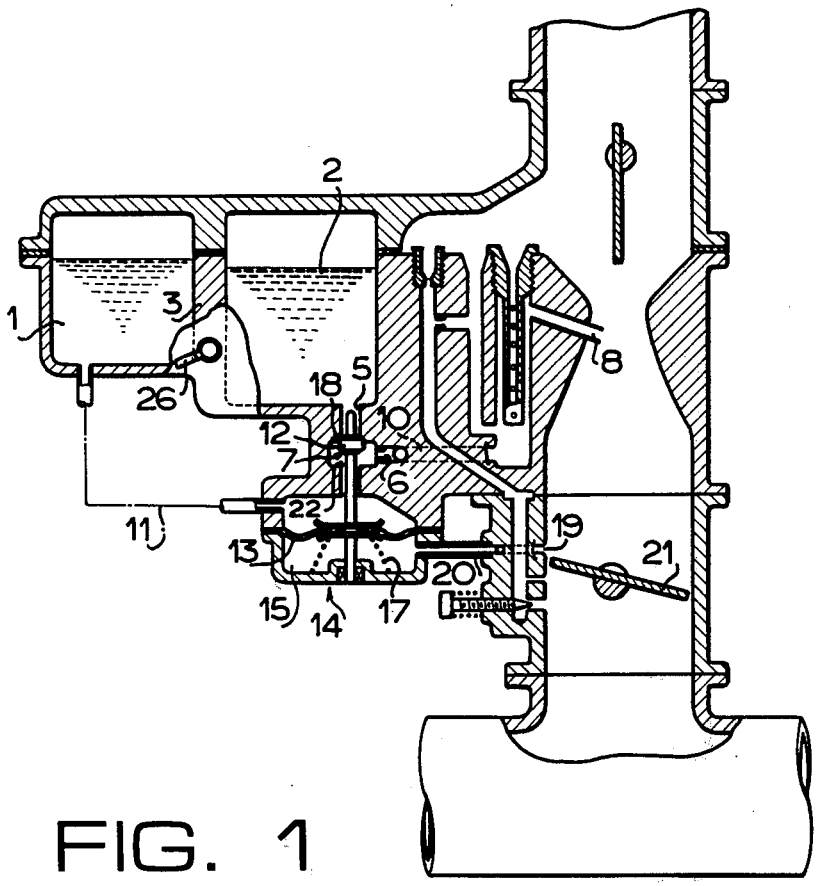
Figure 2:
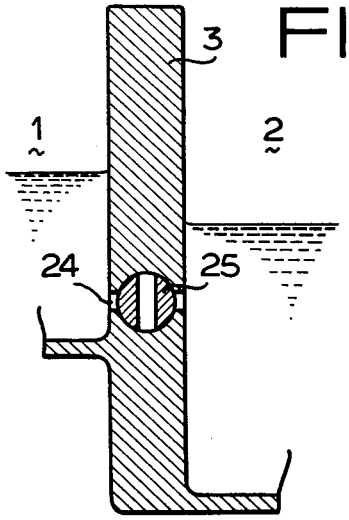
Figure 3:
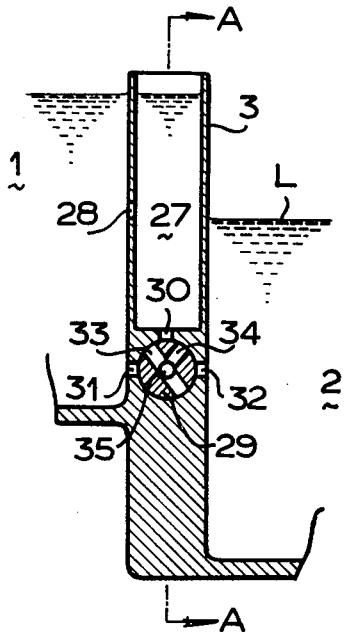
Figure 4:
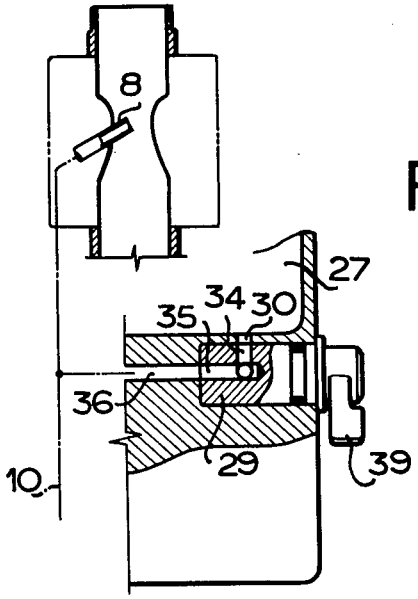
Figure 5:
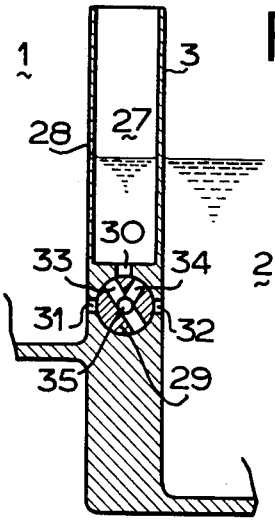
Figure 6:
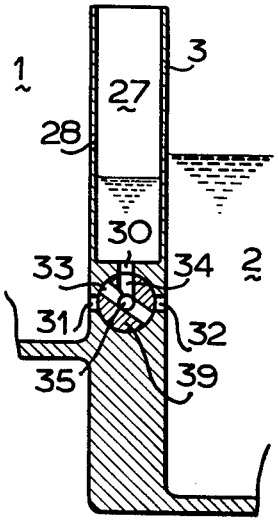
Figure 7:
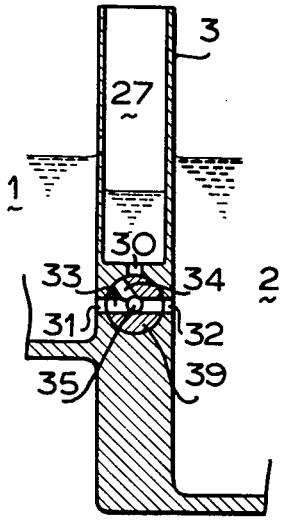

The present invention is described in detail with reference to the accompanying drawings, in which FIG. 1 is a side elevational view partially in section of an embodiment of the present invention, FIG. 2 shows an enlarged fragmentary sectional view of a cock portion, FIG. 3 is a fragmentary sectional view of another embodiment of the present invention, FIG. 4 is a cross-sectional view taken on line A—A of FIG. 3, FIG. 5 shows a state when gasoline runs out, FIGS. 6 and 7 show the operation of the cock.

Referring to the drawings, particularly to FIG. 1, there is shown a fuel supply system for a gasoline-kerosene engine in which a gasoline float chamber 1 and a kerosene float chamber 2 is adjacent each other divided by a partition 3.

In the bottom of the kerosene float chamber 2, a port 5 is provided to communicate to a main jet 6 through a selector valve 7. The main jet 6 is communicated to a main nozzle 8 by a fuel passage 10. The gasoline float chamber is communicated to the selector valve 7 through a conduit 11. The selector valve 7 is provided with a piston 12 connected to a diaphragm 13 of a vacuum actuator 14. The vacuum actuator has a vacuum chamber 15 partitioned by the diaphragm 13. A spring 17 is provided in the vacuum chamber to bias the diaphragm upwardly to abut the piston 12 on the valve seat 18. The vacuum chamber 15 is communicated to a vacuum inlet 19 through a passage 20. The vacuum inlet 19 is provided in the wall of the intake passage of the carburetor at a position near an above idling position of the throttle valve 21.

At the start of the engine, since the vacuum inlet 19 is positioned above the throttle valve 21, intake pressure is atmospheric pressure, and hence the piston 12 is biased upwardly by the spring 17 to close the port 5 and to open the port of the valve seat 22. Accordingly, gasoline in the float chamber 1 is fed to the main nozzle 8 passing through the conduit 11, main jet 6 and fuel passage 10.

When the throttle valve is slightly opened, intake negative pressure is supplied to the vacuum chamber 15 from the vacuum inlet 19, because the vacuum inlet is located below the throttle valve 21. Accordingly, the diaphragm 13 is biased downwardly against the spring 17 by the negative pressure, which causes the piston 12 to move downwardly to open the port 5, but the port of the valve seat 22 is kept in open position by balancing of the spring force and the negative pressure. Thus, kerosene is permitted to flow through the port 5. Accordingly, a mixture fuel of gasoline and kerosene is fed to the main nozzle 8.

At the middle load in which the throttle valve 12 is further opened, the piston 12 abuts on the valve seat 22 to close the port. Thus, only kerosene is fed to the carburetor. At a heavy load, the throttle valve is fully opened, the diaphragm 13 is biased upwardly by the spring 17 so that the port 5 is closed by the piston. Accordingly, gasoline is fed to the carburetor.

In this fuel supply system, if gasoline runs out when idling, no fuel is supplied to the carburetor; therefore the engine stops. If keresone runs out, no fuel is supplied at the middle load, therefore a desirable operation of the engine cannot be carried out. The present invention is to provide a fuel supply system which supplies remaining fuel to the carburetor over all driving conditions for continuing the operation.

As shown in FIG. 2, the both float chambers 1 and 2 are communicated with each other by a passage 24 passing through the partition 3, and a cock 25 operable with a handle 26 is provided in the passage 24.

Usually, as shown in FIG. 2, the cock 25 is positioned to close the passage 24 and each flow chamber containing the respective fuel. When either of the fuels runs out, the cock 25 is operated with the handle 26 to communicate the two float chambers with each other. Accordingly, the engine is kept in operation because a part of remaining fuel in one float chamber flows into the empty float chamber and is supplied to the carburetor.

In the above described system, because when gasoline is used up, kerosene is supplied to the carburetor, it is difficult to start the engine.

The system of the embodiment shown in FIGS. 3 and 4 is provided to solve such problems. Between two float chambers 1 and 2, there is provided a gasoline reservoir 27 which is communicted with the gasoline float chamber 1 by a passage 28 at a higher level than the level L of kerosene float chamber 2, and besides, it is communicated with a cock 29 by a first passage 30 at the bottom thereof.

The cock 29 has a first valve passage 33 which communicates a second passage 31 and a third passage 32 with each other and a second valve passage 34 which makes a certain accute angle with the first passage 33, so as not to communicate the passage 30, 31 and 32 to one another simultaneously. The cock 29 is further provided with an axially extending passage 35 which is connected to the passages 33 and 34 at the intersecting portion thereof. The passage 35 communicates with the passage 36 extending to the fuel supply passage 10.

The cock 29 may be snapped by a click at every stop position. In the ordinary operation, as shown in FIG. 3, no passage of the cock 29 is communicated with passages 30, 31 and 32. As shown in FIG. 5, when gasoline runs out in the float chamber 1, gasoline in the gasoline reservoir 27 remains below thelevel of the passage 28. Then as shown in FIG. 6, the cock 29 is turned by the handle 39 to the position where the second valve passage 34 is communicated with the passage 30. Thus, gasoline in the gasoline reservoir 27 flows through passages 30, 34, 35 and passages 36, 10 and stagnates in the nozzle 8. Therefore, the cock 29 is turned to the next click position to communicate the passages 31, 32 and 33 with one another so that kerosene in the kerosene float chamber 2 flows into the empty gasoline float chamber 1. In such condition, gasoline supplied to nozzle 8 is sucked into the engine by the starting operation of the engine, so that the engine may be reliably started. Then, the operation of the engine may continue by kerosene supplied from both of the float chambers 1 and 2 passing through the passage 10 and the nozzle 8.

As apparent from the above, in accordance with the present invention, even if either of the fuels, gasoline or kerosene, is used, the engine will be drive continuously by remaining fuel. Also, if gasoline runs out, the engine will be started and driven by gasoline from the gasoline reservoir and the remaining kerosene.

What is claimed is:

1. Fuel changeover system for multi-fuel engines comprising wall means forming a first float chamber for lighter fuel and a second float chamber for heavier fuel, a lighter fuel reservoir provided adjacent to said first float chamber, a passage communicating said lighter fuel reservoir with said lighter fuel float chamber at a level higher than the level of heavier fuel in said heavier fuel float chamber, a cock provided for regulation of both of the fuels, first and second valve passages provided in said cock, a first passage adapted to communicate the bottom of said lighter fuel reservoir with said cock, a second passage adapted to communicate said lighter fuel float chamber with said cock, a third passage adapted to communicate said heavier fuel float chamber with said cock, said second valve passage being adapted to communicate said second and third passages with each other, and a passage for communicating said first valve passage in the cock with the nozzle of carburetor.

2. Fuel changeover system for multi-fuel engines comprising wall means forming a first float chamber for lighter fuel and a second float chamber for heavier fuel, a lighter fuel reservoir provided adjacent to said first float chamber, a passage communicating said lighter fuel reservoir with said lighter fuel float chamber at a level higher than the level of heavier fuel in said heavier fuel float chamber, a cock provided for regulation of both of the fuels, first and second valve passages radially provided in said cock, said first and second valve passages being interconnected at the center of said cock, a first passage adapted to communicate the bottom of said lighter fuel reservoir with said cock, a second passage adapted to communicate said lighter fuel float chamber with said cock, a third passage adapted to communicate said heavier fuel float chamber with said cock, said second valve passage being adapted to communicate said second and third passages with each other, and a passage axially provided in said cock for communication with said interconnecting portion of said first and second valve passages and extended to the rear end of the cock.

3. Fuel changeover system for multi-fuel engines comprising wall means forming a first float chamber for lighter fuel and a second float chamber for heavier fuel, said both float chambers being separated by a partition, a lighter fuel reservoir provided in said partition, a passage communicating said lighter fuel reservoir with said lighter fuel float chamber at a level higher than the level of heavier fuel in said heavier fuel float chamber, a cock provided for regulation of both of the fuels, first and second valve passages radially provided in said cock, said first and second valve passages being interconnected at the center of said cock, a first passage adapted to communicate the bottom of said lighter fuel reservoir with said cock, a second passage adapted to communicate said lighter fuel float chamber with said cock, a third passage adapted to communicate said heavier fuel float chamber with said cock, said second valve passage being adapted to communicate said second and third passages with each other, and a passage axially provided in said cock for communication with said interconnecting portion of said first and second valve passages and extended to the rear end of the cock.

* * * * *